US012479679B2

(12) United States Patent
Lee et al.

(10) Patent No.: US 12,479,679 B2
(45) Date of Patent: Nov. 25, 2025

(54) DUAL-USE AUTOMATIC DOCUMENT FEEDER

(71) Applicant: Foxlink Image Technology Co., Ltd., New Taipei (TW)

(72) Inventors: Chien Hui Lee, New Taipei (TW); Pai Hsien Su, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 118 days.

(21) Appl. No.: 18/633,636

(22) Filed: Apr. 12, 2024

(65) Prior Publication Data

US 2025/0058990 A1 Feb. 20, 2025

(30) Foreign Application Priority Data

Aug. 15, 2023 (CN) ..... 202322184197.6

(51) Int. Cl.
*B65H 5/36* (2006.01)
*B65H 5/04* (2006.01)

(52) U.S. Cl.
CPC ..... *B65H 5/04* (2013.01); *B65H 5/36* (2013.01); *B65H 2801/39* (2013.01)

(58) Field of Classification Search
CPC ..... B65H 5/04; B65H 5/36; B65H 2801/39; B65H 2404/632; B65H 2404/633; B65H 2404/693; B65H 2403/942; B65H 29/58; B65H 29/60
See application file for complete search history.

(56) References Cited

U.S. PATENT DOCUMENTS 4,667,951 A * 5/1987 Honjo ..... G03G 15/23 271/304
2019/0064718 A1* 2/2019 Mitsui ..... B65H 7/20
2019/0248613 A1* 8/2019 Morikawa ..... B65H 29/58
2020/0198910 A1* 6/2020 Takato ..... H04N 1/00557
2020/0198916 A1* 6/2020 Shiraiwa ..... B65H 5/068

FOREIGN PATENT DOCUMENTS

JP 60-45236 * 12/2016

* cited by examiner

*Primary Examiner* — Thomas A Morrison

(57) ABSTRACT

A dual-use automatic document feeder includes a tilted feeding path, a horizontal feeding path, a U-turn feeding path, an upper scanning unit and a movable document guider. The horizontal feeding path includes a front opening and a rear opening. The U-turn feeding path is connected between the tilted feeding path and the horizontal feeding path. The upper scanning unit is positioned between the front opening and the rear opening. The movable document guider is positioned at a junction between the U-turn feeding path and the horizontal feeding path. The movable document guider has a pivot end pivotally connected to the U-turn feeding path, a guiding arm slantwise extended downward and rearward from the pivot end to the horizontal feeding path, a blocking end positioned at a terminal end of the guiding arm, and an actuating end positioned at a terminal end of the blocking end.

7 Claims, 8 Drawing Sheets

DUAL-USE AUTOMATIC DOCUMENT FEEDER

CROSS REFERENCE TO RELATED APPLICATIONS

The present application is based on, and claims priority from, China Patent Application No. 202322184197.6, filed Aug. 15, 2023, the disclosure of which is hereby incorporated by reference herein in its entirety.

BACKGROUND OF THE INVENTION

Field of the Invention

The present invention generally relates to a dual-use automatic document feeder, and more particularly to a dual-use automatic document feeder which has a simpler structure and a lower cost.

Description of Related Art

Referring to FIG. 8, a conventional dual-use automatic document feeder 100' is shown. The conventional dual-use automatic document feeder 100' is mounted to a scanner. The conventional dual-use automatic document feeder 100' has a curved normal feeding path 60' and a horizontal thick feeding path 70', so a user may automatically feed stacked general documents into the scanner sequentially through the normal feeding path 60', or the user may feed thicker documents which are bound documents or cards into the scanner through the thick feeding path 70' to proceed with a scanning. Moreover, in order to bring a convenience for the user to get the documents, the thicker documents are usual to be fed in a reverse direction after the thicker documents are scanned, and the thicker documents are fed out through a front opening 71' of the thick feeding path 70'.

In order to avoid the general documents being incorrectly fed to the front opening 71' of the thick feeding path 70' when the general documents are fed through a junction between the normal feeding path 60' and the thick feeding path 70', a movable document guider 80' is provided at the junction between the normal feeding path 60' and the thick feeding path 70'. The movable document guider 80' is connected to a driving motor (not shown) via a torque limiter 81', so that the movable document guider 80' falls naturally by a gravity when the conventional dual-use automatic document feeder 100' feeds the documents in a forward direction, and the movable document guider 80' is lifted when the conventional dual-use automatic document feeder 100' feeds the documents in the reverse direction to feed the thicker documents out through the front opening 71' of the thick feeding path 70'.

However, the conventional dual-use automatic document feeder 100' uses a plurality of transmission gears and the torque limiter 81' for driving the movable document guider 80', the conventional dual-use automatic document feeder 100' has a complicated structure and a higher manufacturing cost.

Thus, it is necessary to provide a dual-use automatic document feeder with a simpler structure and a lower cost.

BRIEF SUMMARY OF THE INVENTION

An object of the present invention is to provide a dual-use automatic document feeder which has a simpler structure and a lower cost. The dual-use automatic document feeder includes a tilted feeding path including a document inlet disposed at an upstream of the tilted feeding path, a horizontal feeding path extending horizontally, a U-turn feeding path, an upper scanning unit and a movable document guider. The horizontal feeding path includes a front opening located at a front of the horizontal feeding path, and a rear opening located at a rear of the horizontal feeding path. The U-turn feeding path is connected between a lower end of the tilted feeding path and the horizontal feeding path to guide a document which is to be fed from the document inlet of the tilted feeding path into the horizontal feeding path. The upper scanning unit is positioned between the front opening and the rear opening, and the upper scanning unit is slidably arranged in a vertical path which is perpendicular to the horizontal feeding path. The movable document guider is positioned at a junction between the U-turn feeding path and the horizontal feeding path to guide the document which is to be fed into the horizontal feeding path. The movable document guider has a pivot end pivotally connected to the U-turn feeding path to rotatably fasten the movable document guider, a guiding arm slantwise extended downward and rearward from the pivot end to the horizontal feeding path to guide the document which is to be fed into the horizontal feeding path, a blocking end positioned at a terminal end of the guiding arm to block a passage that is led from the front opening to the rear opening of the horizontal feeding path, and an actuating end positioned at a terminal end of the blocking end to contact with a housing of the upper scanning unit. When the document passes through a bottom of the upper scanning unit, the upper scanning unit is pushed by the document to make the upper scanning unit be lifted upward by the document, when the upper scanning unit is lifted, the upper scanning unit pushes the actuating end to make the blocking end depart from a junction between the front opening and the rear opening of the horizontal feeding path.

Another object of the present invention is to provide a dual-use automatic document feeder. The dual-use automatic document feeder includes a tilted feeding path including a document inlet disposed at an upstream of the tilted feeding path, a horizontal feeding path extending horizontally, a U-turn feeding path, an upper scanning unit, a lower scanning unit and a movable document guider. The horizontal feeding path includes a front opening located at a front of the horizontal feeding path, and a rear opening located at a rear of the horizontal feeding path. The U-turn feeding path is connected between a lower end of the tilted feeding path and the horizontal feeding path to guide a document which is to be fed from the document inlet of the tilted feeding path into the horizontal feeding path. The upper scanning unit is positioned between the front opening and the rear opening, and the upper scanning unit is slidably arranged in a vertical path which is perpendicular to the horizontal feeding path. The lower scanning unit is fixed to a lower portion of the horizontal feeding path, and the lower scanning unit is positioned opposite to the upper scanning unit to make the lower scanning unit and the upper scanning unit scan both surfaces of the document which is to be fed at the same time. The movable document guider is positioned at a junction between the U-turn feeding path and the horizontal feeding path to guide the document which is to be fed into the horizontal feeding path. The movable document guider has a pivot end pivotally connected to the U-turn feeding path to rotatably fasten the movable document guider, a guiding arm slantwise extended downward and rearward from the pivot end to the horizontal feeding path to guide the document which is to be fed into the horizontal feeding path, a blocking end positioned at a terminal end of the guiding arm to block a passage that is led from the front opening to the rear opening of the horizontal feeding path, and an actuating end positioned at a terminal end of the blocking end to contact with a housing of the upper scanning unit. When the document passes through a bottom of the upper scanning unit, the upper scanning unit is pushed by the document to make the upper scanning unit be lifted upward by the document, when the upper scanning unit is lifted, the upper scanning unit pushes the actuating end to make the blocking end depart from a junction between the front opening and the rear opening of the horizontal feeding path.

Another object of the present invention is to provide a dual-use automatic document feeder. The dual-use automatic document feeder includes a tilted feeding path having a document inlet disposed at an upstream of the tilted feeding path, a horizontal feeding path extending horizontally, a U-turn feeding path, an upper scanning unit and a movable document guider. The horizontal feeding path has a front opening located at a front of the horizontal feeding path, and a rear opening located at a rear of the horizontal feeding path. The U-turn feeding path is connected between a lower end of the tilted feeding path and the horizontal feeding path. The upper scanning unit is positioned between the front opening and the rear opening, and the upper scanning unit is slidably arranged in a vertical path which is perpendicular to the horizontal feeding path. The movable document guider is positioned at a junction between the U-turn feeding path and the horizontal feeding path. The movable document guider has a pivot end, a guiding arm slantwise extended downward and rearward from the pivot end and extended to the horizontal feeding path, a blocking end positioned at a terminal end of the guiding arm, and an actuating end positioned at a terminal end of the blocking end to contact with the upper scanning unit. When a document is fed from the document inlet of the tilted feeding path to the rear opening of the horizontal feeding path, the document is guided by the guiding arm, wherein, when the document is fed from the front opening into the rear opening of the horizontal feeding path, the document contacts with the movable document guider, the document pushes against the blocking end of the movable document guider to make the movable document guider be lifted, and then the document contacts with the upper scanning unit, the document pushes against the upper scanning unit to make the upper scanning unit be lifted, so that the document enters the rear opening of the horizontal feeding path and the upper scanning unit is slid down. When the document is fed from the rear opening to the front opening of the horizontal feeding path the document passes through a bottom of the upper scanning unit, the upper scanning unit is pushed by the document to make the upper scanning unit be lifted upward by the document, when the upper scanning unit is lifted, the upper scanning unit pushes the actuating end to make the blocking end depart from a junction between the front opening and the rear opening of the horizontal feeding path.

As described above, the dual-use automatic document feeder is provided with the tilted feeding path, the front opening and the rear opening of the horizontal feeding path, the upper scanning unit is slidably arranged in the vertical path which is perpendicular to the horizontal feeding path, and the movable document guider and the upper scanning unit mutually abut against each other. When the document passes through the bottom of the upper scanning unit, the upper scanning unit is pushed by the document to make the upper scanning unit be lifted upward by the document, the upper scanning unit directly drives the movable document guider to deflect by a displacement of the upper scanning unit in a vertical direction. As a result, the dual-use automatic document feeder has a simpler structure and a lower manufacturing cost.

BRIEF DESCRIPTION OF THE DRAWINGS

The present invention will be apparent to those skilled in the art by reading the following description, with reference to the attached drawings, in which.

DETAILED DESCRIPTION OF THE INVENTION

Figure 1:
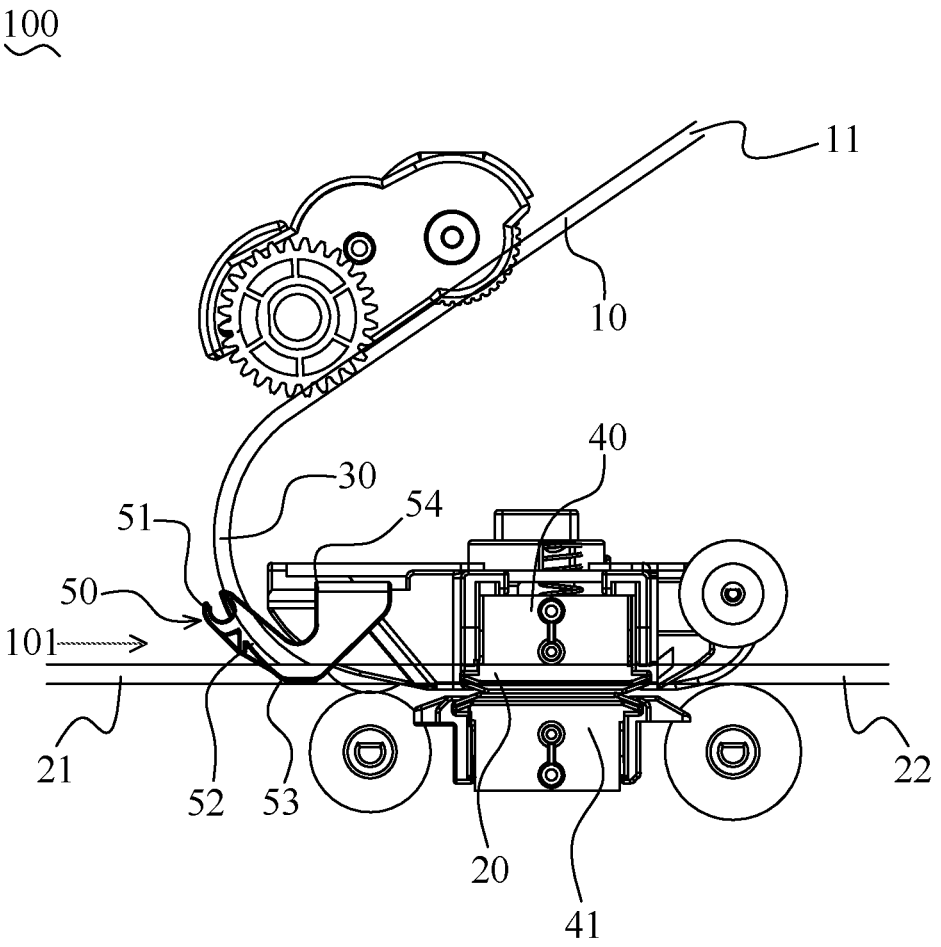
FIG. 1 is a cross-sectional view of a dual-use automatic document feeder in accordance with a preferred embodiment of the present invention.
Figure 2:
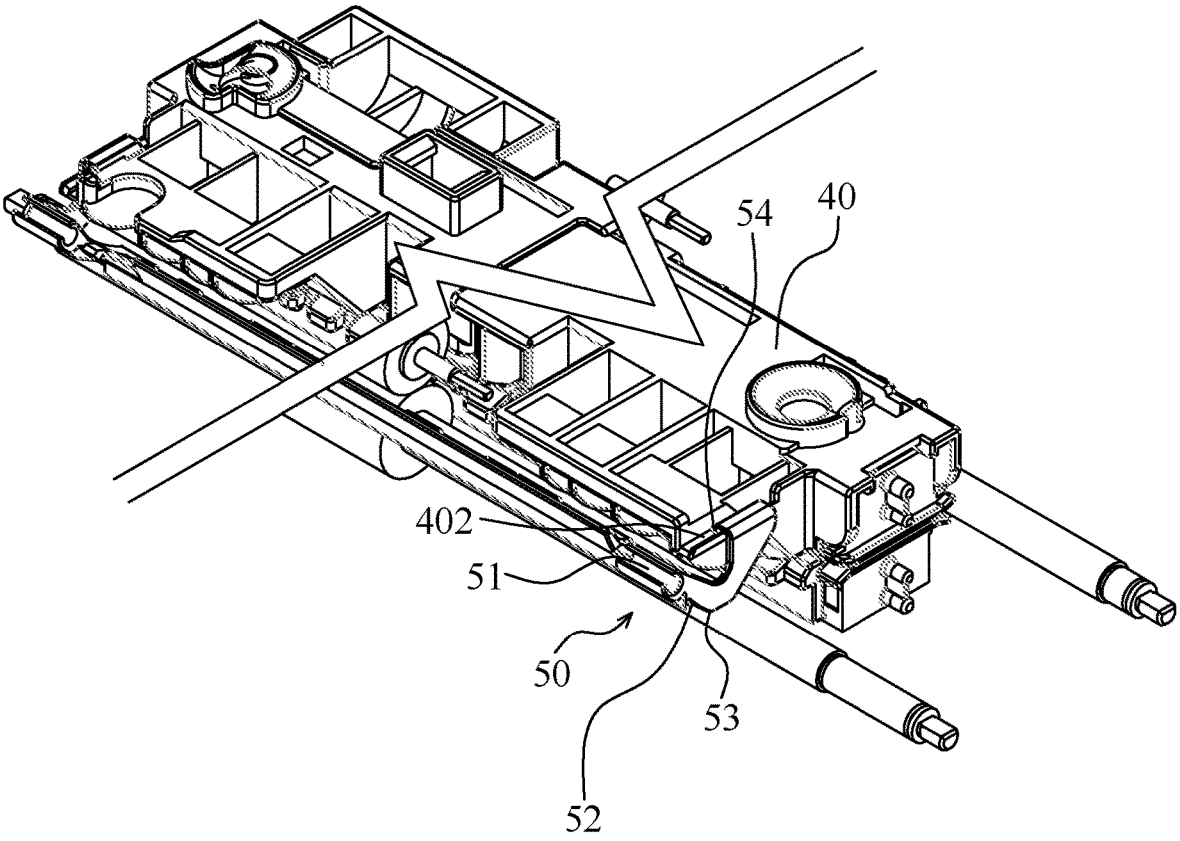
FIG. 2 is a partially perspective view of the dual-use automatic document feeder in accordance with the preferred embodiment of the present invention.

Referring to FIG. 1 and FIG. 2, a dual-use automatic document feeder 100 in accordance with a preferred embodiment of the present invention is shown. The dual-use automatic document feeder 100 includes a tilted feeding path 10, a horizontal feeding path 20, a U-turn feeding path 30, an upper scanning unit 40, a lower scanning unit 41 and a movable document guider 50. For a convenient illustration, a rearward direction in the following description is defined as a direction in which a general document is fed out from the dual-use automatic document feeder 100 after the general document is scanned, and a frontward direction is defined as a direction which is opposite to the rearward direction.

The tilted feeding path 10 includes a document inlet 11 disposed at an upstream of the tilted feeding path 10. The document inlet 11 slantwise extends downward and frontward. The horizontal feeding path 20 extending longitudinally. The horizontal feeding path 20 includes a front opening 21 and a rear opening 22. The front opening 21 and the rear opening 22 extend horizontally. The front opening 21 is located at a front of the horizontal feeding path 20. The rear opening 22 is located at a rear of the horizontal feeding path 20.

Figure 4:
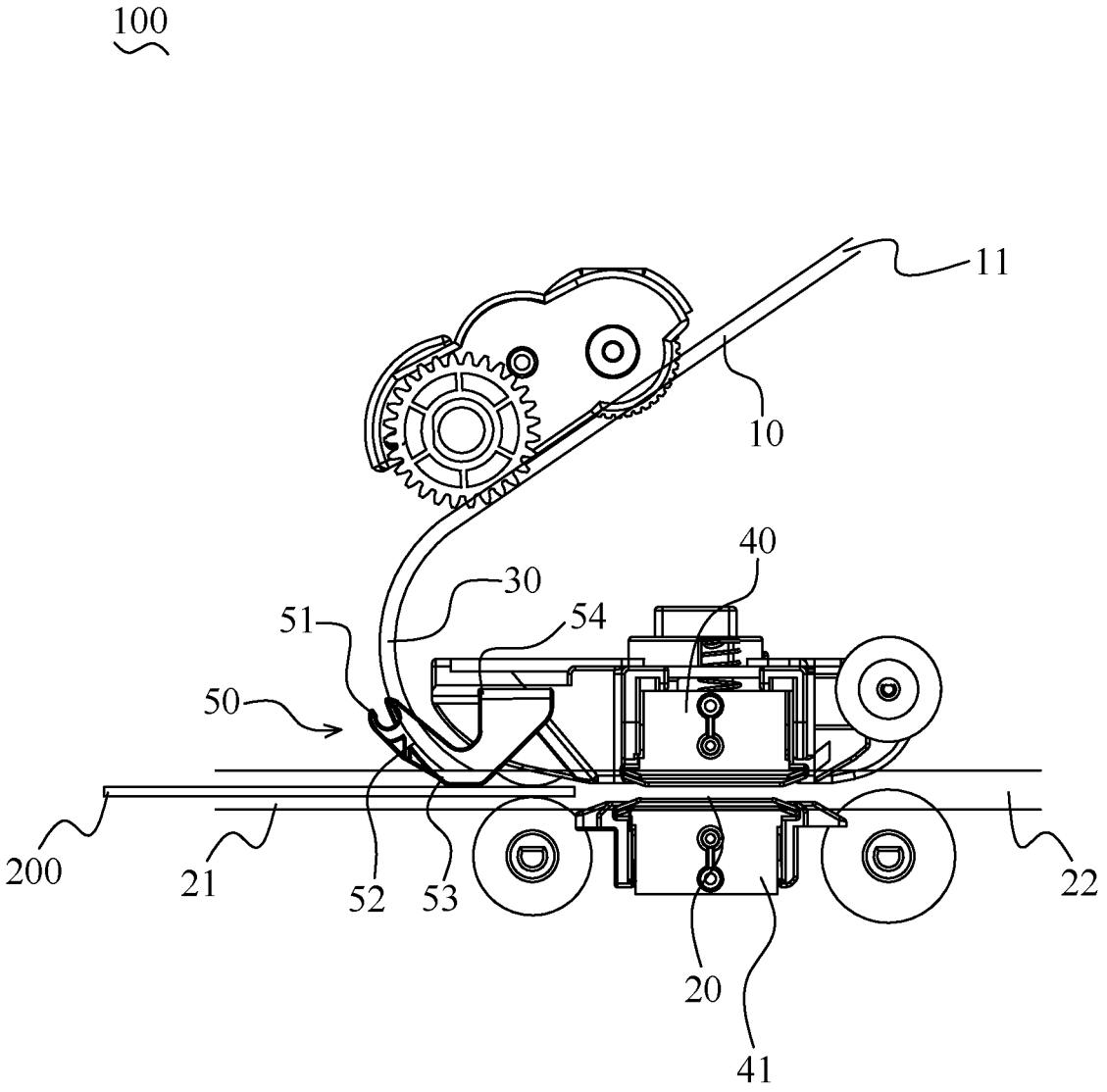
FIG. 4 is a schematic diagram of the dual-use automatic document feeder in accordance with the preferred embodiment of the present invention, wherein thicker documents are fed in a forward direction.

Referring to FIG. 1, FIG. 2 and FIG. 4, the dual-use automatic document feeder 100 is used for feeding a document 200. The document 200 is the general document or thicker documents. In the preferred embodiment, the thicker documents are bound documents. The U-turn feeding path 30 is connected between a lower end of the tilted feeding path 10 and the horizontal feeding path 20 to guide the document 200 which is to be fed from the document inlet 11 of the tilted feeding path 10 into the horizontal feeding path 20.

Referring to FIG. 1 to FIG. 6, the upper scanning unit 40 is fixed to an upper portion of the horizontal feeding path 20. The upper scanning unit 40 is positioned between the front opening 21 and the rear opening 22 to scan the document 200 which is fed to pass through the upper scanning unit 40. The upper scanning unit 40 is slidably arranged in a vertical path 401 which is perpendicular to the horizontal feeding path 20 that appropriate for the documents 200 with various thicknesses and transmitting the documents 200 with the various thicknesses. The lower scanning unit 41 is fixed to a lower portion of the horizontal feeding path 20, and the lower scanning unit 41 is positioned opposite to the upper scanning unit 40 to make the lower scanning unit 41 and the upper scanning unit 40 scan both surfaces of the document 200 which is to be fed at the same time.

The movable document guider 50 is positioned at a junction between the U-turn feeding path 30 and the horizontal feeding path 20 to guide the document 200 which is to be fed into the horizontal feeding path 20. The upper scanning unit 40 abut against the movable document guider 50. When the document 200 passes through a bottom of the upper scanning unit 40, the upper scanning unit 40 is pushed by the document 200 to make the upper scanning unit 40 be lifted upward by the document 200, the upper scanning unit 40 directly drives the movable document guider 50 to deflect by a displacement of the upper scanning unit 40 in a vertical direction.

The movable document guider 50 has a pivot end 51, a guiding arm 52, a blocking end 53 and an actuating end 54. The pivot end 51 is pivotally connected to the U-turn feeding path 30 to rotatably fasten the movable document guider 50. The guiding arm 52 is slantwise extended downward and rearward from the pivot end 51, and the guiding arm 52 is extended to the horizontal feeding path 20 to guide the document 200 which is to be fed into the horizontal feeding path 20. The blocking end 53 is positioned at a terminal end of the guiding arm 52 to block a passage 101 that is led from the front opening 21 to the rear opening 22 of the horizontal feeding path 20. The actuating end 54 is positioned at a terminal end of the blocking end 53 to contact with a housing 402 of the upper scanning unit 40. When the upper scanning unit 40 is lifted, the upper scanning unit 40 simultaneously pushes the actuating end 54 to make the blocking end 53 depart from the junction between the front opening 21 and the rear opening 22 of the horizontal feeding path 20. In the preferred embodiment, the dual-use automatic document feeder 100 includes two movable document guiders 50. The two movable document guiders 50 are positioned at two junctions between the U-turn feeding path 30 and the horizontal feeding path 20.

Figure 3:
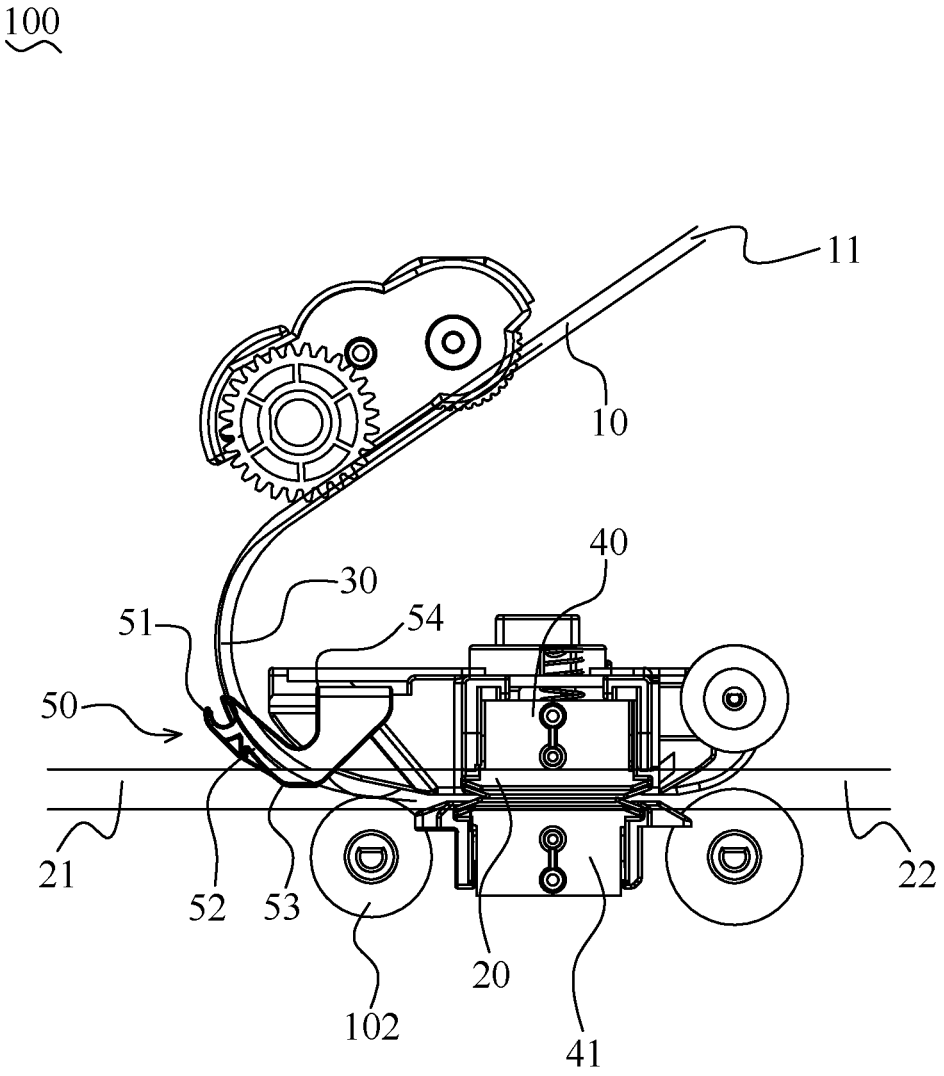
FIG. 3 is a schematic diagram of the dual-use automatic document feeder in accordance with the preferred embodiment of the present invention, wherein a general document is fed by the dual-use automatic document feeder.

Referring to FIG. 3 and FIG. 4, in this preferred embodiment, the movable document guider 50 naturally droops under an own weight action, and the blocking end 53 is caused to fall downward into the horizontal feeding path 20, so that when the user scans the stacked general documents, the general documents are stacked at the document inlet 11, and then the general documents are fed into the tilted feeding path 10 under a drive of feeding rollers 102. When the general documents pass through the U-turn feeding path 30 and the general documents are transmitted into the horizontal feeding path 20, the movable document guider 50 is able to prevent the general documents from moving towards the front opening 21. When the document 200 is guided from the document inlet 11 of the tilted feeding path 10 into the rear opening 22 of the horizontal feeding path 20 by the guiding arm 52, the blocking end 53 of the movable document guider 50 blocks the document 200 from moving to the front opening 21 of the horizontal feeding path 20.

Figure 5:
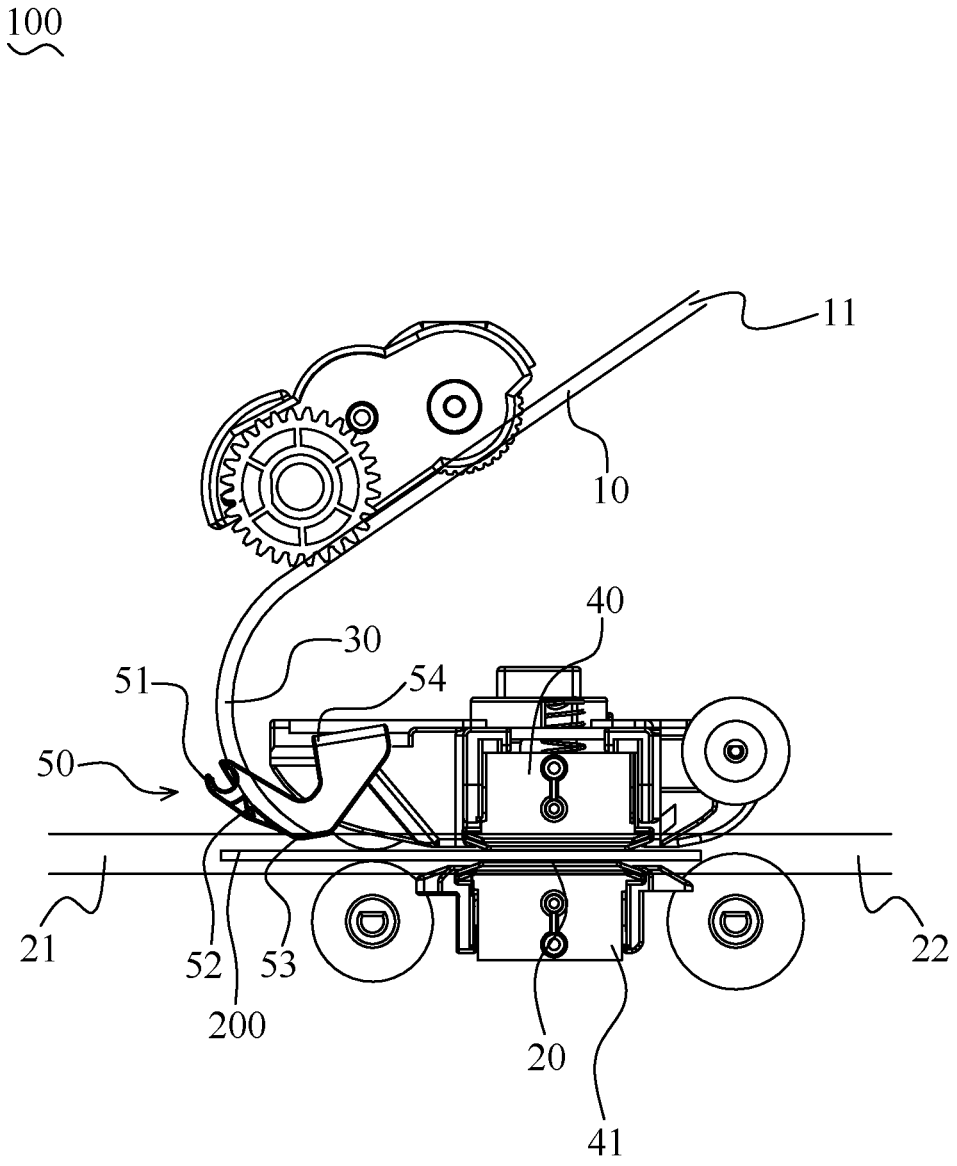
FIG. 5 is a schematic diagram of the dual-use automatic document feeder in accordance with the preferred embodiment of the present invention, wherein the thicker documents are fed in a reverse direction.

Referring to FIG. 4 and FIG. 5, when the user scans the bound documents, the bound documents are fed from the front opening 21 into the rear opening 22 of the horizontal feeding path 20. When the bound documents contact with the movable document guider 50, the bound documents push against the blocking end 53 of the movable document guider 50 to make the movable document guider 50 be lifted in a counterclockwise direction, so that the bound documents enter the horizontal feeding path 20 without an obstruction, and the bound documents pass through the bottom of the upper scanning unit 40.

When the document 200 is fed from the front opening 21 into the rear opening 22 of the horizontal feeding path 20, the document 200 contacts with the movable document guider 50, the document 200 pushes against the blocking end 53 of the movable document guider 50 to make the movable document guider 50 be lifted, so that the document 200 enters the rear opening 22 of the horizontal feeding path 20 without the obstruction. The document 200 passes through the bottom of the upper scanning unit 40. The document 200 is located between the upper scanning unit 40 and the lower scanning unit 41. The upper scanning unit 40 is pushed by the document 200 to make the upper scanning unit 40 be lifted upward by the document 200. The upper scanning unit 40 is lifted by the document 200, and the upper scanning unit 40 brings along the movable document guider 50 to be lifted to a highest position. When the upper scanning unit 40 is lifted, the upper scanning unit 40 pushes the actuating end 54 to make the blocking end 53 depart from the junction between the front opening 21 and the rear opening 22 of the horizontal feeding path 20.

Figure 6:
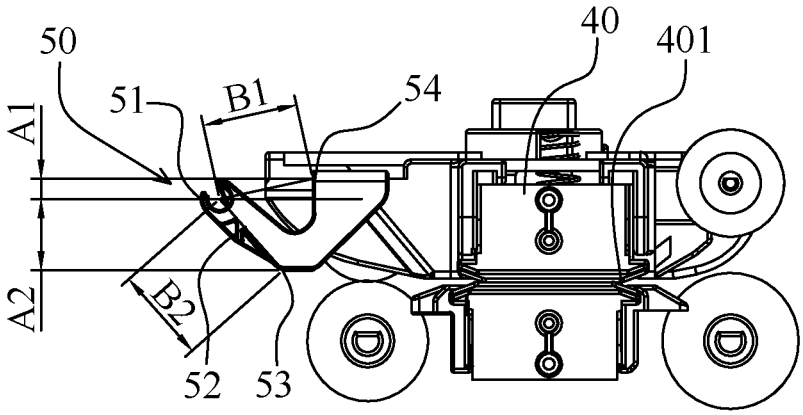
FIG. 6 is a schematic diagram which shows a linkage ratio of the dual-use automatic document feeder in accordance with the preferred embodiment of the present invention, wherein an optical scanning machine is without being lifted.
Figure 7:
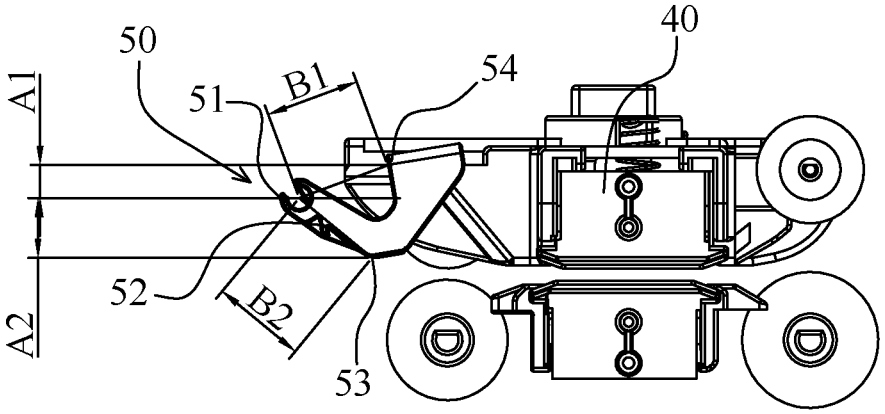
FIG. 7 is a schematic diagram which shows the linkage ratio of the dual-use automatic document feeder in accordance with the preferred embodiment of the present invention, wherein the optical scanning machine is lifted.
Figure 8:
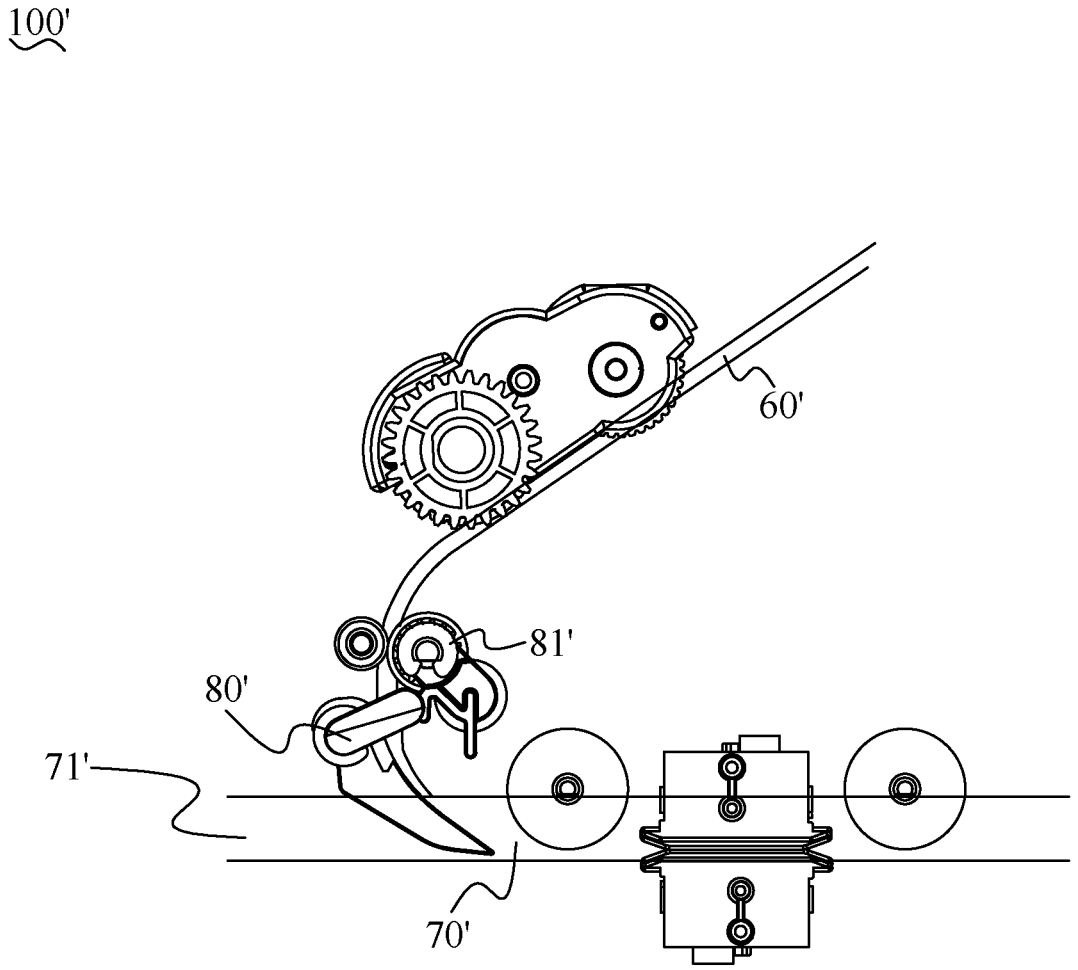
FIG. 8 (Prior Art)
FIG. 8 is a cross-sectional diagram of a conventional dual-use automatic document feeder in prior art.

Referring to FIG. 2, FIG. 5 and FIG. 6, after the bound documents are scanned by a scanner which includes the dual-use automatic document feeder 100, the dual-use automatic document feeder 100 feeds the document 200 in a reverse direction to the front opening 21, specifically, the dual-use automatic document feeder 100 of the scanner feeds the bound documents in the reverse direction to the front opening 21, and the scanner ejects the bound documents out of the front opening 21. Because the bound documents are located under the upper scanning unit 40, the bound documents push against the upper scanning unit 40 to make the upper scanning unit 40 lifted upward. The housing 402 of the upper scanning unit 40 pushes against the actuating end 54 to make the actuating end 54 be lifted upward, and then the movable document guider 50 rotates in the counterclockwise direction, so the blocking end 53 depart away from the junction between the front opening 21 and the horizontal feeding path 20.

Referring to FIG. 1 to FIG. 4, in order to ensure that the movable document guider 50 is just pushed away by the documents 200 which are fed from the front opening 21, and the movable document guider 50 is without being pushed away by the documents 200 which are fed from the tilted feeding path 10, a distance from the pivot end 51 to the blocking end 53 of the movable document guider 50 is greater than a vertical distance from the pivot end 51 to the horizontal feeding path 20, and the blocking end 53 is positioned at a rear lower position of the pivot end 51.

Referring to FIG. 1 to FIG. 7, in order to ensure that the thicker documents fed in the reverse direction and from the horizontal feeding path 20 are able to be fed out smoothly through the front opening 21, and ensure that the general documents are able to be successfully fed to the horizontal feeding path 20 from the tilted feeding path 10, it is necessary to ensure that a lifting height of the actuating end 54 is approximate to a lifting height of the blocking end 53 when the movable document guider 50 is lifted upward by the upper scanning unit 40.

When the movable document guider 50 rotates, a ratio between a first displacement distance (A1) of the actuating end 54 in the direction which is perpendicular to the horizontal feeding path 20 and a second displacement distance (A2) of the blocking end 53 in the direction which is perpendicular to the horizontal feeding path 20 is defined as a linkage ratio (A2/A1). In the preferred embodiment, the linkage ratio of the actuating end 54 and the blocking end 53 is greater than 0.65 and is less than 1.5. And in order to make the linkage ratio be greater than 0.65 and be less than 1.5, a first linear distance (B2) from the blocking end 53 to the pivot end 51 is approximately the same as a second linear distance (B1) from the actuating end 54 to the pivot end 51. When the movable document guider 50 is without being lifted by the upper scanning unit 40, the actuating end 54 is located at a first inclined upper rear direction of the pivot end 51. The first inclined upper rear direction of the pivot end 51 slantwise extends frontward and downward to form an angle of approximately twelve degrees between the first inclined upper rear direction of the pivot end 51 and a horizontal direction. The blocking end 53 is located at a first inclined lower rear direction of the pivot end 51. The first inclined lower rear direction of the pivot end 51 slantwise extends rearward and downward to form an angle of approximately forty-eight degrees between the first inclined lower rear direction of the pivot end 51 and the horizontal direction, so that when the movable document guider 50 is lifted by the upper scanning unit 40, the linkage ratio is approximately 0.684.

When the movable document guider 50 is lifted to the highest position by the upper scanning unit 40, the actuating end 54 is positioned at a second inclined upper rear direction of the pivot end 51. The second inclined upper rear direction of the pivot end 51 slantwise extends frontward and downward to form an angle of approximately twenty degrees between the second inclined upper rear direction of the pivot end 51 and the horizontal direction. The blocking end 53 is located at a second inclined lower rear direction of the pivot end 51. The second inclined lower rear direction of the pivot end 51 slantwise extends rearward and downward to form an angle of approximately forty degrees between the second inclined lower rear direction of the pivot end 51 and the horizontal direction, so that when the movable document guider 50 is lifted by the upper scanning unit 40, the linkage ratio is about 0.806. And in this preferred embodiment, the upper scanning unit 40 and the actuating end 54 are cumulatively lifted by 1.66 mm and the blocking end 53 is cumulatively lifted by 1.5 mm during the whole lifting process, an overall average linkage ratio is 0.903.

As described above, the dual-use automatic document feeder 100 is provided with the tilted feeding path 10, the front opening 21 and the rear opening 22 of the horizontal feeding path 20, the upper scanning unit 40 is slidably arranged in the vertical path 401 which is perpendicular to the horizontal feeding path 20, and the upper scanning unit 40 abut against the movable document guider 50. When the document 200 passes through the bottom of the upper scanning unit 40, the upper scanning unit 40 is pushed by the document 200 to make the upper scanning unit 40 be lifted upward by the document 200, the upper scanning unit 40 directly drives the movable document guider 50 to deflect by the displacement of the upper scanning unit 40 in the vertical direction. As a result, the dual-use automatic document feeder 100 has a simpler structure and a lower manufacturing cost.

What is claimed is:

1. A dual-use automatic document feeder, comprising:

a tilted feeding path having a document inlet disposed at an upstream of the tilted feeding path;

a horizontal feeding path extending horizontally, the horizontal feeding path having a front opening located at a front of the horizontal feeding path, and a rear opening located at a rear of the horizontal feeding path;

a U-turn feeding path connected between a lower end of the tilted feeding path and the horizontal feeding path to guide a document which is to be fed from the document inlet of the tilted feeding path into the horizontal feeding path;

an upper scanning unit positioned between the front opening and the rear opening, and the upper scanning unit being slidably arranged in a vertical path which is perpendicular to the horizontal feeding path; and a movable document guider positioned at a junction between the U-turn feeding path and the horizontal feeding path to guide the document which is to be fed into the horizontal feeding path, the movable document guider having a pivot end pivotally connected to the U-turn feeding path to rotatably fasten the movable document guider, a guiding arm slantwise extended downward and rearward from the pivot end to the horizontal feeding path to guide the document which is to be fed into the horizontal feeding path, a blocking end positioned at a terminal end of the guiding arm to block a passage that is led from the front opening to the rear opening of the horizontal feeding path, and an actuating end positioned at a terminal end of the blocking end to contact with a housing of the upper scanning unit, wherein when the document passes through a bottom of the upper scanning unit, the upper scanning unit is pushed by the document to make the upper scanning unit be lifted upward by the document, when the upper scanning unit is lifted, the upper scanning unit pushes the actuating end to make the blocking end depart from a junction between the front opening and the rear opening of the horizontal feeding path.

2. The dual-use automatic document feeder as claimed in claim 1, wherein a distance from the pivot end to the blocking end of the movable document guider is greater than a vertical distance from the pivot end to the horizontal feeding path, and the blocking end is positioned at a rear lower position of the pivot end.

3. The dual-use automatic document feeder as claimed in claim 1, wherein a ratio between a first displacement distance of the actuating end in a direction which is perpendicular to the horizontal feeding path and a second displacement distance of the blocking end in the direction which is perpendicular to the horizontal feeding path is defined as a linkage ratio, the linkage ratio of the actuating end and the blocking end is greater than 0.65 and is less than 1.5.

4. The dual-use automatic document feeder as claimed in claim 1, further comprising a lower scanning unit fixed to a lower portion of the horizontal feeding path, and the lower scanning unit being positioned opposite to the upper scanning unit to make the lower scanning unit and the upper scanning unit scan both surfaces of the document which is to be fed at the same time.

5. The dual-use automatic document feeder as claimed in claim 1, wherein the dual-use automatic document feeder includes two movable document guiders, the two movable document guiders are positioned at two junctions between the U-turn feeding path and the horizontal feeding path.

6. A dual-use automatic document feeder, comprising:

a tilted feeding path having a document inlet disposed at an upstream of the tilted feeding path;

a horizontal feeding path extending horizontally, the horizontal feeding path having a front opening located at a front of the horizontal feeding path, and a rear opening located at a rear of the horizontal feeding path;

a U-turn feeding path connected between a lower end of the tilted feeding path and the horizontal feeding path to guide a document which is to be fed from the document inlet of the tilted feeding path into the horizontal feeding path;

an upper scanning unit positioned between the front opening and the rear opening, and the upper scanning unit being slidably arranged in a vertical path which is perpendicular to the horizontal feeding path;

a lower scanning unit fixed to a lower portion of the horizontal feeding path, and the lower scanning unit being positioned opposite to the upper scanning unit to make the lower scanning unit and the upper scanning unit scan both surfaces of the document which is to be fed at the same time; and a movable document guider positioned at a junction between the U-turn feeding path and the horizontal feeding path to guide the document which is to be fed into the horizontal feeding path, the movable document guider having a pivot end pivotally connected to the U-turn feeding path to rotatably fasten the movable document guider, a guiding arm slantwise extended downward and rearward from the pivot end to the horizontal feeding path to guide the document which is to be fed into the horizontal feeding path, a blocking end positioned at a terminal end of the guiding arm to block a passage that is led from the front opening to the rear opening of the horizontal feeding path, and an actuating end positioned at a terminal end of the blocking end to contact with a housing of the upper scanning unit, wherein when the document passes through a bottom of the upper scanning unit, the upper scanning unit is pushed by the document to make the upper scanning unit be lifted upward by the document, when the upper scanning unit is lifted, the upper scanning unit pushes the actuating end to make the blocking end depart from a junction between the front opening and the rear opening of the horizontal feeding path.

7. A dual-use automatic document feeder, comprising:

a tilted feeding path having a document inlet disposed at an upstream of the tilted feeding path;

a horizontal feeding path extending horizontally, the horizontal feeding path having a front opening located at a front of the horizontal feeding path, and a rear opening located at a rear of the horizontal feeding path;

a U-turn feeding path connected between a lower end of the tilted feeding path and the horizontal feeding path;

an upper scanning unit positioned between the front opening and the rear opening, and the upper scanning unit being slidably arranged in a vertical path which is perpendicular to the horizontal feeding path; and a movable document guider positioned at a junction between the U-turn feeding path and the horizontal feeding path, the movable document guider having a pivot end, a guiding arm slantwise extended downward and rearward from the pivot end and extended to the horizontal feeding path, a blocking end positioned at a terminal end of the guiding arm, and an actuating end positioned at a terminal end of the blocking end to contact with the upper scanning unit, wherein when a document is fed from the document inlet of the tilted feeding path to the rear opening of the horizontal feeding path, the document is guided by the guiding arm wherein when the document is fed from the front opening to the rear opening of the horizontal feeding path, the document contacts with the movable document guider, the document pushes against the blocking end of the movable document guider to make the movable document guider be lifted, and then the document contacts with the upper scanning unit, the document pushes against the upper scanning unit to make the upper scanning unit be lifted, so that the document enters the rear opening of the horizontal feeding path and the upper scanning unit is slid down, and wherein when the document is fed from the rear opening to the front opening of the horizontal feeding path, the document passes through a bottom of the upper scanning unit, the upper scanning unit is pushed by the document to make the upper scanning unit be lifted upward by the document, when the upper scanning unit is lifted, the upper scanning unit pushes the actuating end to make the blocking end depart from a junction between the front opening and the rear opening of the horizontal feeding path.

* * * * *